United States Patent [19]

Ray et al.

[11] 4,455,211

[45] Jun. 19, 1984

[54] COMPOSITION SUITABLE FOR INERT ELECTRODE

[75] Inventors: Siba P. Ray, Pittsburgh, Pa.; Robert A. Rapp, Columbus, Ohio

[73] Assignee: Aluminum Company of America, Pittsburgh, Pa.

[21] Appl. No.: 483,693

[22] Filed: Apr. 11, 1983

[51] Int. Cl.[3] ..... C25C 3/00; C25B 11/04

[52] U.S. Cl. ..... 204/293; 204/292

[58] Field of Search ..... 204/292, 293

[56] References Cited

U.S. PATENT DOCUMENTS 4,399,008 8/1983 Ray ..... 204/67

*Primary Examiner*—John F. Niebling

*Attorney, Agent, or Firm*—Andrew Alexander; John P. Taylor

[57] ABSTRACT

An inert electrode composition suitable for use in the production of metal by the electrolytic reduction of a metal compound dissolved in a molten salt is disclosed. The composition is formulated from a body containing metals and metal compounds designed to undergo displacement reaction upon sintering to form an interwoven network. The body also contains at least one non-reactive material, e.g., metal compound or metal. The interwoven network contains at least a metal compound and a second material, both resulting from the displacement reaction, the second material selected from the group consisting of free metal and a metal alloy or a mixture thereof.

18 Claims, 8 Drawing Figures

75 X

20Fe, 60NiO, $20Fe_3O_4$, isostatically pressed and sintered at 1350°C. Approximately 21 vol % NiFe alloy present; density 5.5 g/cc.

75 X

20Fe, 60NiO, $20Fe_3O_4$, uniaxially pressed at 25,000 psi, sintered at 1350°C in argon. Approximately 16 vol % NiFe alloy present; density 5.4 g/cc.

NICKEL 500 X

500 X

OXYGEN 500 X

IRON 500 X

COMPOSITION SUITABLE FOR INERT ELECTRODE

The Government has rights in this invention pursuant to Contract No. DE-FC07-80CS40158 between DOE and Alcoa.

BACKGROUND OF THE INVENTION

This invention relates to the production of metals such as aluminum, lead, magnesium, zinc, zirconium, titanium, silicon and the like by the electrolytic reduction of oxides or salts of the respective metals. More particularly, the invention relates to an inert type electrode composition useful in the electrolytic production of such metals.

Conventionally, metals such as aluminum, for example, are produced by electrolysis of alumina dissolved in molten salts using carbon electrodes. However, the oxygen released by the reduction of alumina reacts with the carbon electrodes to form carbon dioxide resulting in the decomposition and consumption of the carbon electrodes. As a result, about 0.33 pounds of carbon must be used for every pound of aluminum used. Carbon such as that obtained from petroleum coke is normally used for such electrodes. However, because of the increasing costs of such cokes, it has become economically attractive to find a new material for the electrodes. A desirable material would be one which would not be consumed, i.e., one resistant to oxidation, and which would not be dissolved by the molten salt bath. In addition, the new material should be capable of providing a high energy efficiency, i.e., have a high conductivity, should not affect the purity of metal, should have good mechanical properties and should be economically acceptable with respect to the cost of raw material and with respect to fabrication.

Numerous efforts have been made to provide an inert electrode having the above characteristics but apparently without the required degree of success to make it economically feasible. That is, the inert electrodes in the art appear to be reactive to an extent which results in contamination of the metal being produced as well as consumption of the electrode. For example, U.S. Pat. No. 4,039,401 reports that extensive investigations were made to find nonconsumable electrodes for molten salt electrolysis of aluminum oxide, and that spinel structure oxides or perovskite structure oxides have excellent electronic conductivity at a temperature of 900° to 1000° C., exhibit catalytic action for generation of oxygen and exhibit chemical resistance. Also, in U.S. Pat. No. 3,960,678, a process is disclosed for operating a cell for the electrolysis of aluminum oxide with one or more anodes, the working surface of which is of ceramic oxide material. However, according to the patent, the process requires a current density above a minimum value to be maintained over the whole anode surface which comes in contact with the molten electrolyte to minimize the corrosion of the anode. Thus, it can be seen that there remains a great need for an electrode which is substantially inrt or is resistant to attack by molten salts or molten metal to avoid contamination and its attendant problems.

It has been proposed that an inert electrode be constructed using ceramic oxide compositions having a metal powder dispersed therein for the purpose of increasing the conductivity of the electrode. For example, when an electrode composition is formulated from NiO and $Fe_2O_3$, a highly suitable metal for dispersing through the composition is nickel which may increase the conductivity of the electrode by as much as or more than 30 times.

However, it has been found that the search for inert electrode materials possessing the requisite chemical inertness and electrical conductivity is further complicated by the need to preserve certain mechanical characteristics which may be either enhanced or impaired by modifications to enhance the chemical resistance or electrical conductivity. For example, the electrode should possess certain minimum mechanical strength characteristics as tested by criteria for rupture, fracture toughness, and expansion as well as resistance to thermal shock of the electrode material, and the ability to weld electrical connections thereto must also be taken into account. An article entitled "Displacement Reactions in the Solid State" by R. A. Rapp et al, published May 1973, in Volume 4 of Metallurgical Transactions, at pages 1283–1292, points out the different morphologies which can result from the addition of a metal or metal alloy to an oxide mixture. The authors show that some additions result in layers of metal or metal oxides while others form aggregate arrangements which may be lamellar or completely interwoven. The authors suggest that interwoven-type microstructures should be ideal for the transfer of stresses and resistance to crack propagation and demonstrated that such were not fractured by rapid cooling. The authors suggested that such an interwoven structure would be useful in the preparation of porous electrodes for fuel cells or as catalysts for reactions between gases by selective dissolution of either the metal or oxide phase.

SUMMARY OF THE INVENTION

In accordance with the invention, an inert electrode composition suitable for use in the production of metal by the electrolytic reduction of a metal compound dissolved in a molten salt is provided. The composition is formulated from a body containing metals and metal compounds designed to undergo displacement reaction on sintering to form an interwoven network. The body also contains at least one non-reactive metal powder. The interwoven network contains a metal compound and a second material, both resulting from the displacement reaction, the second material selected from the group consisting of free metal and a metal alloy or a mixture thereof.

DETAILED DESCRIPTION OF THE INVENTION

The invention provides an inert electrode composition suitable for use in the production of metals such as aluminum by electrolytic reduction of their oxides or salts in a molten salt bath. The electrode composition provides a high degree of chemical inertness to attack by the bath while providing good electrical conductivity and satisfactory mechanical properties.

The electrode composition of the present invention is particularly suited for use as an anode in an aluminum producing cell. In one preferred aspect, the composition is particularly useful as an anode for a Hall cell in the production of aluminum. That is, when the anode is used, it has been found to have very high resistance to bath used in a Hall cell. For example, the electrode composition has been found to be resistant to attack by cryolite ($Na_3AlF_6$) type electrolyte baths when operated at temperatures around 950°-1000° C. Typically, such baths can have a weight ratio of NaF to $AlF_3$ in a range of about 1.0:1 to 1.4:1. Also, the electrode has been found to have outstanding resistance to lower temperature cryolite type baths where the $NaF/AlF_3$ ratio can be in the range of from 0.5 up to 1.1:1. Low temperature baths may be operated typically at temperatures of about 800° to 850° C. utilizing the electrode composition of the invention. While such baths may consist only of $Al_2O_3$, NaF and $AlF_3$, it is possible to provide in the bath at least one halide compound of the alkali and alkaline earth metals other than sodium in an amount effective for reducing the operating temperature. Suitable alkali and alkaline earth metal halides are LiF, $CaF_2$ and $MgF_2$. In one embodiment, the bath can contain LiF in an amount between 1 and 15%.

Figure 1:
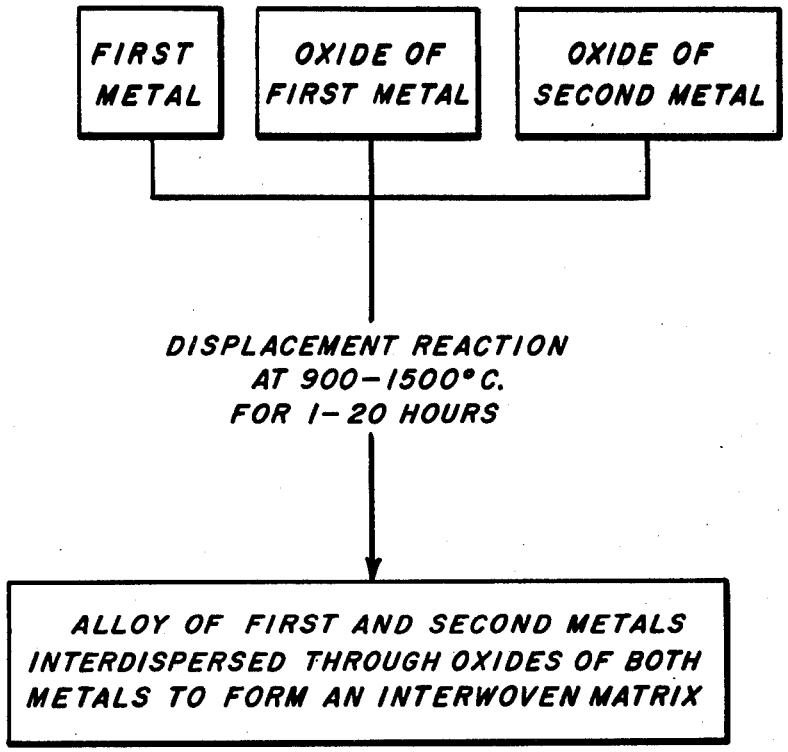
FIG. 1 is a flowsheet illustrating the invention.
Figure 2:
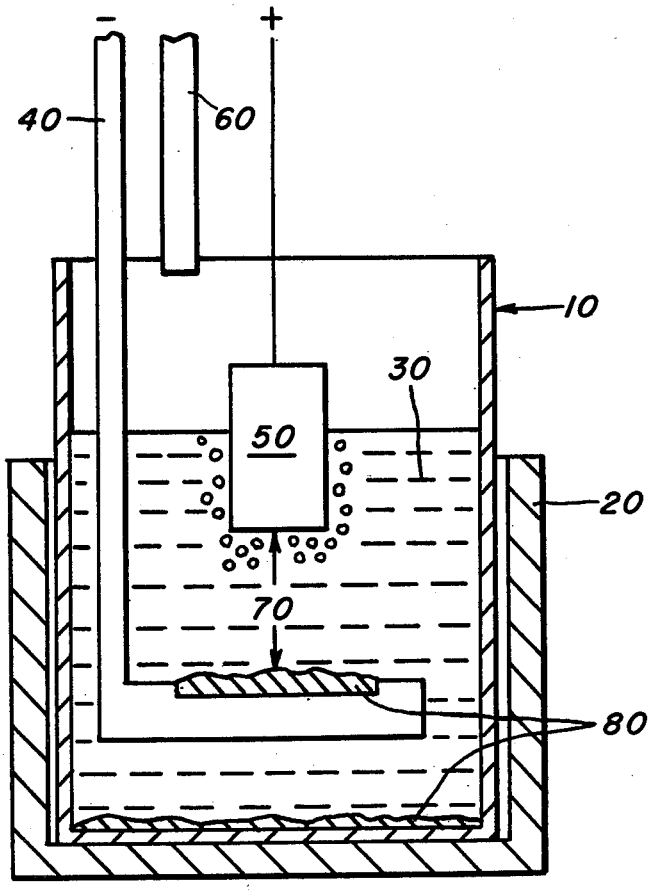
FIG. 2 is a schematic representation of an electrolytic cell showing the inert electrode of the invention being tested.

A cell of the type in which anodes having compositions in accordance with the invention were tested is shown in FIG. 2. In FIG. 2, there is shown an alumina crucible 10 inside a protection crucible 20. Bath 30 is provided in the alumina crucible and a cathode 40 is provided in the bath. An anode 50 having an inert electrode also in the bath is shown. Means 60 is shown for feeding alumina to the bath. The anode-cathode distance 70 is shown. Metal 80 produced during a run is represented on the cathode and on the bottom of the cell.

The novel electrode composition is formed by reacting together two or more metal-containing reactants to provide an in situ displacement reaction whereby the metal or metals in one reactant displace a certain amount of the metal in the other reactant, and the displaced metal then may form an alloy or alloys with one or more of the metals present. The first reactant is selected from the class consisting of a metal and a metal compound. The second reactant is a metal compound. In accordance with the invention, the resultant alloy or alloys or a free metal may be dispersed throughout the material in an interwoven matrix with the metal compounds resulting in a composition having enhanced electrical conductivity and mechanical strength.

Not all combinations of metals and metal compounds will, by displacement reaction, form a composition whose morphology is that of an interwoven matrix of free metal or alloy and metal compounds comprising metal salts or metal oxides. The Rapp et al article entitled "Displacement Reactions in the Solid State", previously referred to and specifically incorporated herein by reference, describes the displacement reaction of nickel and copper oxide as forming a layered product morphology consisting respectively of copper oxide, copper, nickel oxide and nickel layers. Similar reaction is disclosed for cobalt and copper oxide, while iron and copper oxide are said to form a lamellaraggregate arrangement wherein layers of metallic copper and metallic iron are separated by a layer having a mixture of metallic copper and iron oxide.

In contrast, the displacement reaction, for example, of iron and nickel oxide results in small outer layers of iron and nickel oxide, respectively, separated by a large layer comprising what is described as two substantially interwoven and continuous phasews or an interwoven aggregate of a nickel-iron alloy and nickel-iron oxide.

Thus, the metals and metal compounds useful in the invention include those metals and metal compounds which will react to provide free metal or form an alloy or alloys dispersed throughout the reaction product in an interwoven matrix with the resultant metal compounds resulting from the reaction.

While the invention will be illustrated by the use of one or more metals reacting with one or more metal oxides, the term "metal compounds" as used herein is intended to embrace not only metal oxides but also materials containing oxygen as well. Examples of such include, for example, oxyborides, oxynitrides and oxyhalides. In addition, the use of non-oxygen compounds such as, for example, the use of metal borides, nitrides, carbides, halides and sulfides, should also be deemed to be within the scope of the term "metal compounds" as used herein.

The initial reactants in the displacement reaction may include more than one metal as well as more than one metal compound. For example, in the preferred embodiment of the invention in which a nickel-iron alloy is interwoven with nickel-iron oxides, the reactants comprise metallic iron and oxides of both iron and nickel. This reaction can be illustrated by the following formula:

$Fe+NiO+Fe_3O_4$ or $Fe_2O_3 \rightarrow$ Ni-Fe alloy$+Ni_xFe_{1-x}O+Ni_yFe_{3-y}O_4$ where $0<x<1.0$ and $0<y<1.0$ and preferably $0.6<x<1$ and $0.7<y<1$. In accordance with the invention, the resulting composition should contain 5-50 vol.% of the metal alloy or alloys, e.g. Ni-Fe alloy, preferably 10-35 vol.%, and most preferably 15-25 vol.%. The ratio of metals in the alloy or alloys may vary considerably. The metal compounds, which in the preferred embodiment comprise metal oxides, comprise the balance of the resulting composition. The metal compounds in the final composition will not necessarily be the same as the initial metal compound reactants, but may rather be complex reaction products of the displacement reaction. For example, when metallic iron is reacted with iron oxide and nickel oxide, as shown in the formula above, mixed oxides of nickel and iron are formed. In addition, Fe, Ni, NiO and Fe-oxides may be mixed and reaction sintered to produce the electrode of the present invention. Other elements that can be used with or in place of Ni are Co, Cu, Pt, Rh or Ir, for example.

Figure 5A:
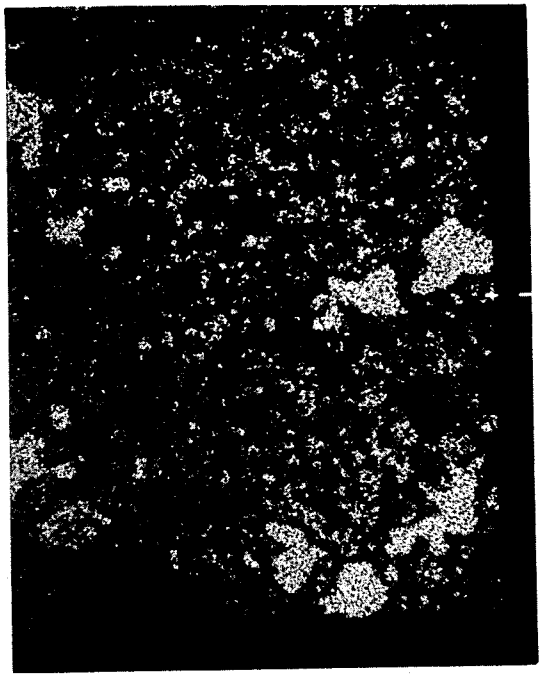
FIG. 5*a* is a photomicrograph X-ray image for nickel corresponding to FIG. 5.
Figure 5:
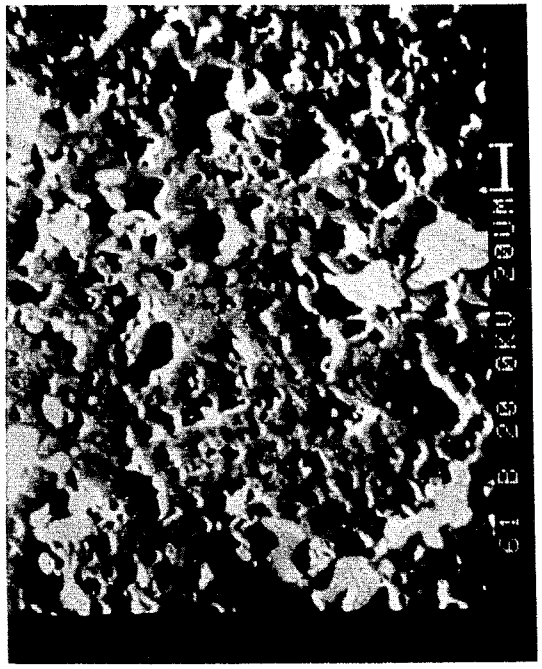
FIG. 5 is a photomicrograph back scattered electron image at 500X of an Ni-Fe-O electrode composition in accordance with the invention showing substantially continuous metallic areas throughout the ceramic matrix.
Figure 6A:
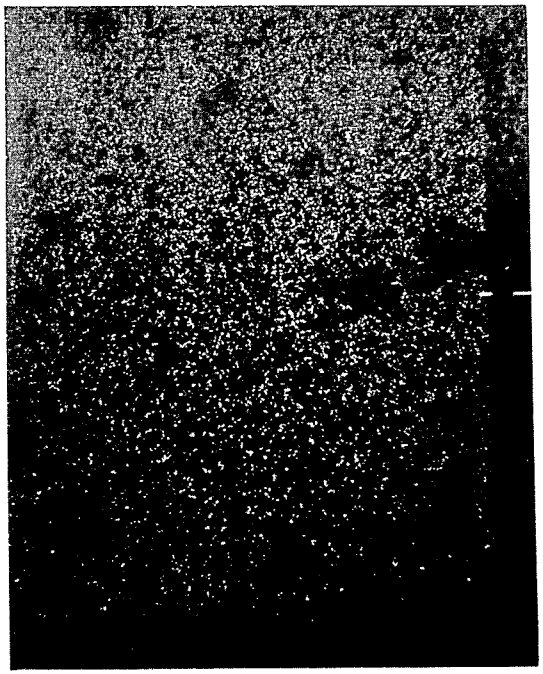
FIG. 6a is a photomicrograph X-ray image for oxygen corresponding to FIG. 5.
Figure 6:
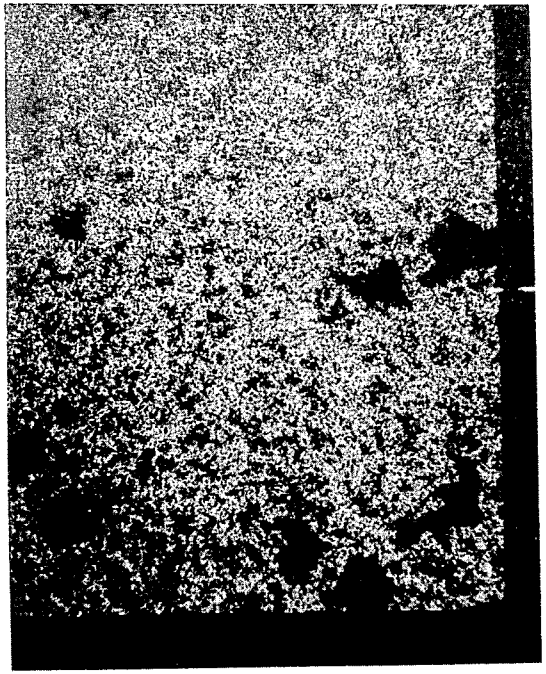
FIG. 6 is a photomicrograph X-ray image for iron corresponding to FIG. 5.

Referring to FIG. 5, there is shown a photomicrograph showing a backscattered electron image from an inert electrode composition containing 9.53 wt.% Fe, 50.97 wt.% NiO and 39.5 wt.% $Fe_3O_4$. This photograph shows the nature of or continuity of the dispersed or interwoven alloy of a cermet in accordance with the invention. FIGS. 5a, 6 and 6a show corresponding Ni, Fe and O containing areas of the cermet of the invention. Examination of the figures confirms the virtual absence of oxygen in the metallic areas, and FIGS. 5a and 6 confirm the presence of large amounts of Ni and small amounts of Fe in the metallic alloy.

The initial reactants used to form the above composition should comprise 5–35 wt.% of one or more metals, preferably 5–30 wt.%, with the balance comprising one or more metal compounds. In the preferred embodiment, the reactants comprise 5–30 wt.% Fe metal, 0–25 wt.% $Fe_3O_4$, 50–70 wt.% NiO and 0–35 wt.% of one or more additional metal compounds, as will be described below.

The reactants can be initially blended by mixing powders of the reactants screened to below 100 mesh (Tyler Series) and uniaxially die pressed at 10–30,000 psi. The initial composition is then reacted by sintering, preferably in an inert atmosphere, at from 900°–1500° C., preferably 1150°–1350° C. for a period of 1 to 20 hours. Longer periods of time could be used but are not necessary and, therefore, are not economical. If non-oxygen bearing metal compounds are used as the non-metallic reactants, a controlled oxygen atmosphere may be substituted for the inert atmosphere to permit formation in situ of a controlled amount of oxides in the final composition.

The initial reactants may also be formed into an electrode using isostatic pressing techniques well known to those skilled in the art. The electrode is then reaction sintered using the same parameters just discussed for uniaxially pressed electrodes.

In another embodiment, the reactants may be hot pressed to form the electrode during the reaction of the initial composition. In this embodiment, the powdered initial reactants are uniaxially pressed at a pressure of about 1,000 to 3,000 psi for about 15 minutes to one hour at a temperature of about 750°–950° C. Care must be exercised, in the practice of this embodiment, in selection of die materials which will be inert to the displacement reaction taking place within the dies during the formation of the electrode. For example, boron nitride-coated graphite dies have been used, and dies made out of sintered alumina can also be used. It should be further noted here that hot isostatic pressing can also be used in this embodiment.

As mentioned above, additional metal compounds, such as additional metal oxides, may be added to the original reactants if desired to alter some of the chemical or electrical characteristics of the resultant composition. For example, when iron is reacted with iron oxide and nickel oxide, it has been found that the resultant composition, while providing an inert electrode having satisfactory to excellent electrical and mechanical properties in an electrolytic cell, yields aluminum pot metal which may, in certain instances, have an undesirably high Fe or Ni level.

However, the use of up to 30 wt.% of one or more other compounds, including oxides such as, for example, compounds of Al, Mg, Ca, Co, Si, Sn, Ti, Cr, Mn, Nb, Ta, Zr, Cu, Li and Y appears to result in the formation of compounds from which the iron or the nickel component can be more difficult to leach or dissolve during subsequent function as an inert electrode in an electrolytic cell for production of metal such as aluminum.

If desired, after formation of the novel composition of the invention, an inert electrode assembly, including connectors to be joined thereto, can be fabricated therefrom suitable for use in a cell for the electrolytic reduction of metal such as aluminum. Ceramic fabrication procedures well known to those skilled in the art can be used to fabricate such electrodes in accordance with the present invention.

Also, in electrolytic cells, such as Hall cells, claddings of the composition of the invention may be provided on highly conductive members which may then be used as anodes. For example, a composition as defined by the formulas referred to hereinabove may be sprayed, e.g. plasma sprayed, onto a conductive member to provide a coating or cladding thereon. This approach can have the advantage of lowering or reducing the length of the resistance path between the highly conductive member and the molten salt electrolyte and thereby significantly lowering the overall resistance of the cell. Highly conductive members which may be used in this application can include metals such as stainless steels, nickel, iron-nickel alloys, copper and the like whose resistance to attack by molten salt electrolyte might be considered inadequate yet whose conductive properties can be considered highly desirable. Other highly conductive members to which the composition of the invention may be applied include, in general, sintered compositions of refractory hard metals including carbon and graphite.

The thickness of the coating applied to the conductive member should be sufficient to protect the member from attack and yet be maintained thin enough to avoid unduly high resistances when electrical current is passed therethrough. Conductivity of the coating should be at least 0.01 $ohm^{-1}\ cm^{-1}$.

In another embodiment of the subject invention, it has been discovered that the conductivity of the electrode composition, as defined hereinabove, can be increased significantly by providing in or dispersing therethrough at least one metal selected from the group consisting of Co, Ni, Cu, Pt, Rh and Ir or alloys thereof, for example. When the metal is provided in the electrode composition, the amount should not constitute more than 30 vol.% metal, with the remainder being the composition which undergoes or results from the displacement reaction. In a preferred embodiment, the nonreactive metal provided in the composition can range from about 0.1 to 25 vol.%, with suitable amounts being in the range of 1 to about 20 vol.%.

While reference has been made to specific metal powders, it should be noted that other metals may be used, depending to some extent on the materials, e.g., metals, metal compounds or metalloids, e.g. Si, being subjected to reaction sintering. Further, metal compounds can be used which are substantially non-reactive with respect to reaction sintering but which are highly resistant to attack by electrolyte. In addition, the non-reactive material or compound may be one which forms a compound or alloy with products of reaction sintering to provide enhanced conductivity or to provide a compound which is highly resistant to electrolyte. Typical of such non-reactive compounds with respect to reaction sintering are nitrides or oxynitrides, fluorides or oxyfluorides and chlorides or oxychlorides. Thus, it will be seen that a level of conductivity and inertness may be obtained which cannot be obtained with the products of reaction sintering. It will be understood that metal or metal alloy formed together with the metal or alloy from reaction sintering can oxidize during use to provide a superior level of inertness.

By non-reactive is meant that an additional metal or metal compound is present in the body of materials undergoing displacement reaction and that this additional material does not enter into the displacement reaction. However, it should be noted that sometimes the addition of material while it does not enter into the displacement reaction can change or alter its particular composition by having materials in contact therewith diffuse, for example, thereinto. This may be exemplified by the presence of nickel, for example, in an NiO, $Fe_2O_3$ or $Fe_3O_4$, Fe system, wherein the nickel, while it is substantially non-reactive, may on examination show that Fe may have diffused or alloyed into the nickel material which results in an Ni-Fe alloy. It will be understood that in other systems, the reaction sintering will still take place; however, the change experienced by the non-reactive constituent or component may be substantially non-existant or the degree or mode may be different from the NiO, $Fe_2O_3$ system noted above.

When the electrode composition is formulated by reaction sintering using Fe, NiO and iron oxide (e.g., $Fe_2O_3$, $Fe_3O_4$ or FeO), a highly suitable metal for dispersing through the composition is nickel. In this system, nickel can be present in the range of about 5 to 30 wt.%, with a preferred amount being in the range of 5 to 15 wt.%.

In addition, it has been found that the addition of metallic material, e.g., metal powders which are non-reactive or do not enter into the displacement reaction, are important for another reaction. That is, as has been explained earlier, after the displacement reaction, free metal or alloy is provided in or with the interwoven network. However, the free metal associated with the network can be leached or oxidized and removed from the network by electrolyte or bath, for example, interfering with the inertness of the electrode composition. Providing or mixing non-reactive components, e.g., metal powders or compounds thereof, in or with the reactants or materials taking place in the displacement reaction can provide a metal, for example, which can be alloyed with the free metal resulting from the displacement reaction. The alloy can form a complex oxide in situ which has greater resistance to chemical action of the electrolyte. Thus, this approach can provide an electrode composition which has high levels of conductivity and also high levels of resistance to electrolyte or other chemical solutions.

For purposes of combining the electrode composition and metal, one suitable method includes grinding of the electrode composition, for example, resulting from the nickel oxide and iron oxide combination, to a particle size in the range of 25 to 400 mesh (Tyler Series) and providing the metal in a particle size in the range of 100 to 400 mesh (Tyler Series), powdered nickel or copper, for example.

The following examples will serve to further illustrate the invention.

EXAMPLE I

A composition consisting of 20 wt.% $Fe_3O_4$, 60 wt.% NiO and 20 wt.% Fe metal as powders of −100 mesh (Tyler Series) was uniaxially die pressed at 172 MPa into 2.5 cm (1 inch) diameter rods and sintered in an argon atmosphere at 1350° C. for 14 hours.

Figure 4:
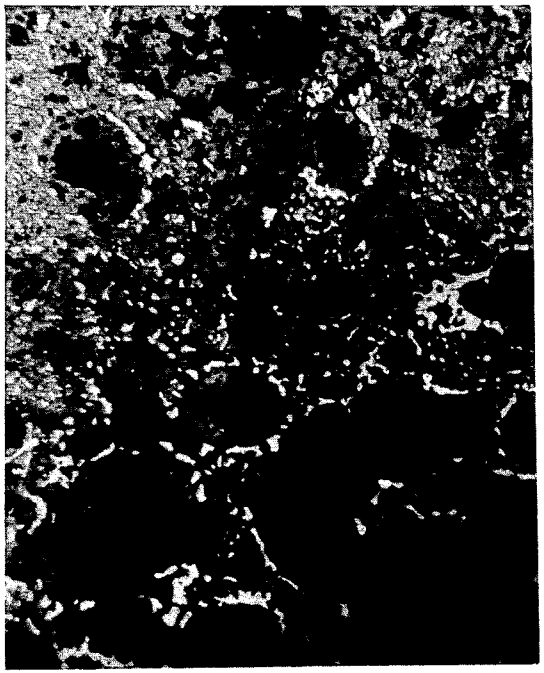
FIG. 4 is a photomicrograph of another electrode made in accordance with the invention.
Figure 3:
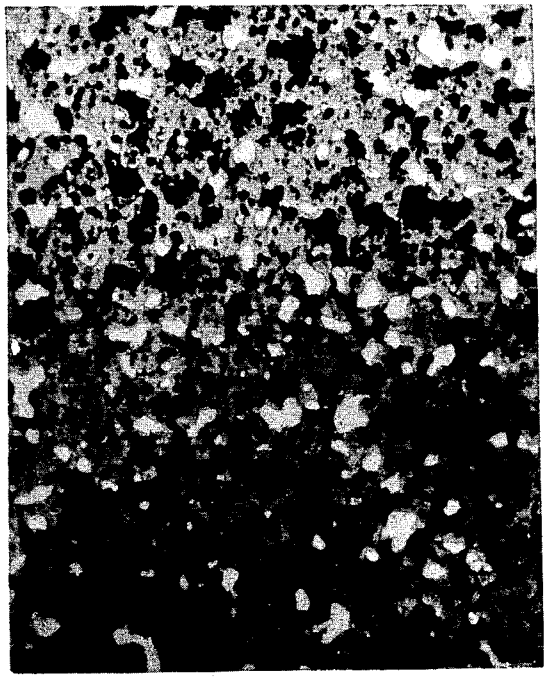
FIG. 3 is a photomicrograph of an electrode made in accordance with the invention.

FIGS. 3 and 4 are photomicrographs of the resultant reaction composition which show the dispersal of the Ni-Fe alloy with the Ni-Fe oxides.

Six of the sintered rods were then partially reduced by contacting one end of the rod with carbon (graphite) in an argon atmosphere and by raising the temperature at 100° C. per hour up to 800° C. It was held at 800° C. for 16 hours and then raised to 960° C. at the same rate and held at this temperature for 5 hours. Thereafter, it was cooled to 800° C. at 100° C. per hour and held at 800° C. for an additional 16 hours. The rods were then cooled to room temperature at 100° C. per hour. Ni-200 rod was then welded to the reduced end by TIG welding.

The thermal expansion of the composition under vacuum was then measured and determined to be $10^{-6}$ cm/cm/°C. at 1000° C. which was deemed to be satisfactory.

A second set of electrodes was also formed using the same powder reactants. The reactants, however, were hot pressed for 30 minutes at a temperature of about 850° C. and a pressure of 2,000 psi in a press containing dies which were coated with boron nitride.

The electrical conductivity of the electrodes was then measured together with a carbon electrode and an electrode made using 7.6 wt.% Fe, 60.93 wt.% NiO and 31.47 wt.% $Fe_3O_4$. The results are listed in Table I below.

TABLE I

| Sample Composition | Conductivity in 1/ohm-cm (at 1000° C.) |
|---|---|
| 1. Carbon | 250 |
| 2. 20% Fe, 60% NiO, 20% $Fe_3O_4$ | 339 (cold pressed) |
| 3. 20% Fe, 60% NiO, 20% $Fe_3O_4$ | 700 (hot pressed) |
| 4. 7.6% Fe, 60.93% NiO, 31.47% $Fe_3O_4$ | 14 |

A test was also run to determine the effect of current density and the amounts of Fe and Ni in the resultant aluminum metal. The results are shown in Table II.

TABLE II

| Anode Current Density (Amps/cm²) | Current Efficiency | Bath Ratio | Aluminum Analysis (wt. %) Fe | Ni |
|---|---|---|---|---|
| 1.0* | 88 | 1.00–1.3 | 0.23 | 0.02 |
| 1.0 | 67 | 1.11–1.17 | 0.57 | 0.02 |
| 1.0 | 95 | 1.05–1.16 | 0.34 | 0.023 |
| 1.5* | 87 | 1.13–1.15 | 0.15 | 0.017 |
| 1.5 | 77 | 1.15–1.27 | 0.25 | 0.01 |
| 2.0 | 97 | 1.14–1.30 | 0.16 | 0.03 |

*These tests were conducted in a fresh bath. The other baths were tapped from a conventional production cell. The ratios are the weight percent NaF to $AlF_3$ amounts in the bath.

Five of the rods were then evaluated as anodes in a conventional Hall cell operating at 960° C. with 5% $CaF_2$. The results are shown in Table III.

TABLE III

| Anode | Time (hours) | Current Efficiency | Bath Ratios | Aluminum Analysis (wt. %) Fe | Ni |
|---|---|---|---|---|---|
| 1 | 33 | 88 | 1.09–1.3 | 0.23 | 0.02 |
| 2 | 37 | 90+ | 1.12–1.3 | 0.1 | 0.01 |
| 3 | 42 | 56 | 1.03–1.2 | 0.6 | 0.09* |
| 4 | 24 | 86 | 1.14–1.0 | 0.48 | 0.11** |

TABLE III-continued

| Anode | Time (hours) | Current Efficiency | Bath Ratios | Aluminum Analysis (wt. %) Fe | Ni |
|---|---|---|---|---|---|
| 5 | 68 | 78 | 1.16–1.11 | 0.85 | 0.22** |

*The electrode eventually shorted to the metal pad.
**These runs were conducted using a commercial Hall cell bath.

The electrodes were all examined after the test to determine breakage, cracks, oxidation, etc., to determine both the mechanical as well as the chemical inertness (which is also indicated by the amount of Fe and Ni in the aluminum produced by the cell).

In each instance, the electrodes appeared to have withstood the bath operating temperatures without apparent significant mechanical or chemical degradation. The current efficiencies and conductivity measurements indicated satisfactory electrical properties as well.

An inert electrode was fabricated in accordance with the invention by reaction sintering a composition containing 60 wt.% NiO, 20 wt.% Fe, 18 wt.% $Fe_3O_4$ and 2 wt.% $Al_2O_3$ under the same conditions as described in Example I. The resulting electrode was placed in operation for 28 hours in a cell similar to that shown in FIG. 2. The aluminum metal produced using this electrode contained only 0.13 wt.% Fe and 0.015 wt.% Ni. Optical microscopy of the electrode after the test revealed that a very thin oxide layer (0.2 mm) was formed. It was also noted that the electrode appeared to have formed an $(Ni, Fe, Al)_3O_4$ spinel around the bottom corner of the electrode.

As in the tests performed in Example I, the anode appeared to have performed well with regard to mechanical properties and chemical stability as well as providing satisfactory electrical properties.

Thus, the inert electrode composition of the invention possesses satisfactory chemical, mechanical and electrical properties necessary for use in the production of metal by electrolytic reduction of metal oxides or salts in a molten salt bath.

What is claimed is:

1. An inert electrode suitable for use in the production of metal by the electrolytic reduction of a metal compound dissolved in a molten salt comprising a composition consisting essentially of:
   (a) an interwoven network resulting from the displacement reaction of:
      (1) a first reactant selected from the class consisting of a metal and a metal compound; and
      (2) a second reactant consisting of at least one metal compound,
      said first and second reactants being capable of reacting to form an interwoven network consisting essentially of:
      (1) at least one metal compound; and
      (2) a second material selected from the group consisting of free metal, a metal alloy, or a mixture thereof; and
   (b) at least one metal or metal compound which is nonreactive in said displacement reaction.

2. The inert electrode of claim 1 wherein said non-reactive metal or metal compound increases the conductivity of said electrode.

3. The electrode composition in accordance with claim 1 wherein the non-reactive metal or metal compound is in the range of 0.1 to 25 vol.%.

4. The electrode composition in accordance with claim 1 wherein the non-reactive material is provided in powder form and has a particle size of not more than −100 mesh (Tyler Series).

5. The electrode composition in accordance with claim 1 wherein the non-reactive material is a metal.

6. The electrode composition in accordance with claim 1 wherein the non-reactive material is a metal compound.

7. The inert electrode of claim 1 wherein at least one of said metal compounds in said interwoven network comprises one or more oxygen-bearing compounds.

8. The inert electrode of claim 1 wherein at least one of said metal compounds in said interwoven network comprises a metal oxide.

9. The inert electrode of claim 1 wherein at least one of said metal compounds in said interwoven network comprises a plurality of metal oxides.

10. The inert electrode of claim 6 wherein more than one metal oxide is present in the interwoven network of said composition and at least one of said oxides contains more than one of the metals present in said second material.

11. The inert electrode of claim 1 wherein said metal compound of said interwoven network comprises a plurality of metal compounds, at least one of which includes more than one metal contained in said second material.

12. The inert electrode of claim 1 wherein 5 to 50 vol.% of said interwoven network consists of said second material.

13. The composition in accordance with claim 1 wherein said interwoven network comprises at least one nickel-iron oxide with a nickel-iron alloy dispersed therethrough.

14. The composition of claim 13 wherein the nickel-iron oxides have the respective formulas: $Ni_xFe_{1-x}O$ and $Ni_xFe_{3-x}O_4$.

15. The composition of claim 14 wherein the ratios of alloy and oxides are: 5 to 50 vol.% alloy, 0 to 30 vol.% $Ni_xFe_{1-x}O$ and the balance $Ni_xFe_{3-x}O_4$.

16. The composition of claim 1 wherein said metal compound of said interwoven network consists essentially of nickel-iron compounds and at least one compound selected from the class consisting of compounds of Al, Mg, Ca, Co, Si, Sn, Ti, Cr, Mn, Zr, Cu, Nb, Ta, Li and Y.

17. The electrode in accordance with claim 1 wherein the non-reactive metal compound is selected from the group consisting of metal nitrides, fluorides, chlorides, oxynitrides, oxyfluorides and oxychlorides.

18. The electrode in accordance with claim 1 wherein the interwoven network is formulated by the reaction sintering of iron, iron oxide and nickel oxide, and the non-reactive metal is at least one of Co, Ni, Cu, Pt, Rh and Ir and alloys thereof.

* * * * *